US009903209B2

(12) United States Patent
Krueckels et al.

(10) Patent No.: US 9,903,209 B2
(45) Date of Patent: Feb. 27, 2018

(54) ROTOR BLADE AND GUIDE VANE AIRFOIL FOR A GAS TURBINE ENGINE

(71) Applicant: ALSTOM Technology Ltd, Baden (CH)

(72) Inventors: Joerg Krueckels, Birmenstorf (CH); Marc Widmer, Winterthur (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 306 days.

(21) Appl. No.: 14/574,897

(22) Filed: Dec. 18, 2014

(65) Prior Publication Data

US 2015/0176412 A1 Jun. 25, 2015

(30) Foreign Application Priority Data

Dec. 20, 2013 (EP) ..... 13198810

(51) Int. Cl.
*F01D 5/18* (2006.01)
*F01D 9/02* (2006.01)

(52) U.S. Cl.
CPC ..... *F01D 5/187* (2013.01); *F01D 9/02* (2013.01); *F05D 2250/292* (2013.01); *F05D 2260/2212* (2013.01); *F05D 2260/22141* (2013.01)

(58) Field of Classification Search
CPC .. F01D 5/187; F01D 9/02; F05D 2260/22141; F05D 2250/292; F05D 2260/2212
See application file for complete search history.

(56) References Cited

U.S. PATENT DOCUMENTS 7,637,720 B1 12/2009 Liang
7,694,522 B2 * 4/2010 Nakae ..... F23R 3/002 60/752

(Continued)

FOREIGN PATENT DOCUMENTS

EP 0 661 414 A1 7/1995
EP 0661414 A1 * 7/1995 ..... F01D 5/187

(Continued)

OTHER PUBLICATIONS

Office Action issued Apr. 1, 2017 in corresponding Chinese Patent Application No. 2014107956251, and English translation thereof (11 pages).

*Primary Examiner* — Igor Kershteyn
*Assistant Examiner* — Brian P Wolcott
(74) *Attorney, Agent, or Firm* — Buchanan Ingersoll & Rooney PC

(57) ABSTRACT

The invention refers to a rotor blade or guide vane airfoil for a gas turbine engine having a longitudinal axis and a source of cooling fluid. The airfoil has a pressure wall, a suction wall, a leading edge, a trailing edge and at least one cooling fluid flow passage. The cooling fluid flow passage is in fluid communication with the source of cooling fluid. Means for directing cooling fluid at least to the trailing edge are provided, whereas the cooling fluid flow passage including: a plurality of axially extending walls, each of the walls extending laterally between the pressure wall and suction wall. The plurality of walls are radially spaced within the cooling fluid flow passage such that adjacent pairs of walls define a channel. The axial spacing between the adjacent walls include in radial direction of the airfoil a pins and a ribs structure, wherein the pins holistic or approximately cover the axial height of the channel. The ribs have a deeper (Continued)

level with respect to the pins and the ribs establish a bridge-like connection between each of adjacent ribs.

9 Claims, 2 Drawing Sheets

(56) References Cited

U.S. PATENT DOCUMENTS

| | | | | |
|---|---|---|---|---|
| 2005/0106021 | A1* | 5/2005 | Bunker | F01D 5/187 416/97 R |
| 2010/0221121 | A1* | 9/2010 | Liang | F01D 5/187 416/97 R |
| 2011/0164960 | A1 | 7/2011 | Maldonado | |

FOREIGN PATENT DOCUMENTS

| | | | |
|---|---|---|---|
| EP | 0 945 595 | A2 | 9/1999 |
| EP | 1 508 746 | A1 | 2/2005 |
| EP | 2 011 970 | A2 | 1/2009 |

* cited by examiner

ROTOR BLADE AND GUIDE VANE AIRFOIL FOR A GAS TURBINE ENGINE

CROSS-REFERENCE TO RELATED APPLICATIONS

This application claims priority to European application 13198810.7 filed Dec. 20, 2013, the contents of which are hereby incorporated in its entirety.

TECHNICAL FIELD

The present invention relates to the field of heat transfer characteristics of a flowing passage with pins and ribs and improving heat transfer coefficient.

A rotor blade or guide vane airfoil for a gas turbine engine having a longitudinal axis and a source of cooling fluid, the airfoil having a pressure wall, a suction wall, a leading edge, a trailing edge and at least one cooling fluid flow passage, whereas the cooling fluid flow passage in fluid communication with the source of cooling fluid and providing means for directing cooling fluid at least to the trailing edge, whereas the cooling fluid flow passage including: a plurality of axially extending walls, each of the walls extending laterally between the pressure wall and suction wall, whereas the plurality of walls being radially spaced within the cooling fluid flow passage such that adjacent pairs of walls define a channel, whereas the axial spacing between the adjacent walls comprising in radial direction of the airfoil a pins and a ribs structure.

BACKGROUND

The gas turbine community continually seeks to increase the thermal efficiency and power output by increasing the turbine inlet temperature to beyond the melting temperature of turbine airfoil vanes and blades. Effective cooling schemes are required to protect the gas turbine components from failure. Many cooling techniques for example film cooling, pin fins cooling and rib-turbulated cooling are employed to protect the airfoils, preventing the airfoils from failure while extending durability.

According to EP 1 508 746 A1 a heat exchange wall includes a base plate, a plurality of first protrusions distributed on a surface of the base plate, and a plurality of second protrusions distributed on the base plate surface. The height of the second protrusion in a normal direction of the base plate is desirably less than ½ of a height of the first protrusion in the normal direction. The height of the second protrusion in the normal direction is desirably between 1/20 and ¼ of the height of the first protrusion in the normal direction. More desirably, the height of the second protrusion in the normal direction is 1/10 of the height of the first protrusion in the normal direction.

According to the document ASME 2001-GT-0178 pin fins are normally used for cooling the trailing edge region of a turbine, where their aspect ratio (height H/diameter D) is characteristically low. In small turbine vanes and blades, however, pin fins may also be located in the middle region of the airfoil. In this case, the aspect ratio can be quite large, usually obtaining values greater than 4. Heat transfer tests, which are conducted under atmospheric conditions for the cooling design of turbine vanes and blades, may overestimate the heat transfer coefficient of the pin-finned flow channel for such long pin fins. The fin efficiency of a long pin fin is almost unity in a low heat transfer situation as it would be encountered under atmospheric conditions, but can be considerably lower under high heat transfer conditions and for pin fins made of low conductively material.

Referring to ASME GT 2011-46078 a pin-fin array is usually rows of short circular cylindrical elements generally arranged in staggered configurations in a narrow channel with cooling fluid passing over the array. This appears to be an effective heat transfer enhancement method, but is accompanied with a pressure loss. Pin fins are usually attached perpendicularly to both end-walls inside the narrow cooling channel, for example of a gas turbine airfoil. According to this document, FIG. 2 shows schematically a pin-rib geometry viewed from the top and the side of the channel. Various Figures show the top view of the top end-wall mounted with pin-fins. A further Figure illustrates the side view of the staggered pin-fins configuration in the test section. The top and bottom end-wall are identical and the bottom end-wall is arranged by shifting on pitch downstream of the top end-wall.

Generally, referring to the pressure loss coefficient it is noted that the heat transfer enhancement is usually accompanied by penalty of additional pressure loss. Any element protruding from the end-wall, i.e. pin fins and ribs, will obstruct the flow causing drag and head loss in the system.

SUMMARY

Accordingly, an object of the invention as defined in the claims is to provide improvements over state of the art in connection with an implementation of pins with ribs in a channel to cool turbine vanes and blades aft part.

An advantageous embodiment provides a converging channel as needed in aft part of turbine vanes or rotor blades. Furthermore, depending of the operational use, the sectional bodies of the cooling channel can have be shaped with a continually increasing or decreasing cone angle in the direction of flow along the channel. It can be envisaged that the bodies shaping the structure of the flow channel each have a cylindrical initial part.

Pins are connected with ribs for a better castability, and the pin diameter is adapted to channel height. Ribs enhance heat transfer coefficient in the required area, where the pin height is larger and the coolant velocity smaller.

Pin span-wise pitch is decreased, where the channel height and the pin diameter gets smaller get required heat transfer coefficient, but the staggered arrangement is kept. In order to keep a regular pattern the span-wise pitch of the larger pins should be equal or multiple of the pitch of the smaller pins downstream.

Rib height (h) is adapted to pin height, wherein rib height (h) is adapted to certain fraction of pin height. Rib width (w) at the bottom is adapted to castability requirement, wherein the width should be larger than 60% of the height.

When the height of the rib is low, turbulence generated by the top portion of the rib reaches the base plate surface to promote heat exchange. This embodiment is effective in case the pin has a low thermal conductivity. The reason of this result is because the base plate of the channel can be cooled more efficiently by cooling the surface of the base plate directly rather than cooling the side face of the pin of the low thermal conductivity. When the diameter of round pin is small, the projection area in the direction of the cooling air flow decreases so that the pressure loss can be suppressed.

The height of the ribs is limited relative to the height of the pins, wherein the pins extend over the whole opening of the channel. The top and bottom end-wall comprise individually a ribs structure in connection with each adjacent pins.

The ribs have a square or rectangular or trapezoidal cross-section, adapting to castability requirement; moreover, the leading face is provided along the entire length of the rib between two adjacent spin with an inclined or tapered surface in the flow direction of the cooling medium. Accordingly, in this case flowing of the inclined or tapered surface corresponds to one side aligned vortex generator.

Additionally, the flowed surface of the ribs in the direction of flow corresponds to a vortex generator comprises a tapered surface along the entire length of the rib between two adjacent spins.

Moreover, the flowed surface of the ribs in the direction of flow corresponds to a vortex generator essentially comprises three triangular surfaces around which flow occurs. Accordingly, the length of the ribs between two adjacent ribs may be formed by a number of such generators. These are a top surface and two side surfaces. In their longitudinal extent, these surfaces run at certain angles in the direction of flow. The side walls of the vortex generators, which preferably consist of right-angled triangles, are fixed, preferably gastight, with their longitudinal sides to the channel wall already above discussed. They are orientated in such a way that they form a face at their narrow sides while enclosing an acute or arrow angle. The face is embodied as a sharp connecting edge and is perpendicular to every channel wall with which the side surfaces are flush. The two side surfaces enclosing the arrow angle are symmetrical in form, size and orientation and they are arranged on both sides of a symmetry axis which is equi-directional to the duct axis.

The mode of operation of the vortex generator is as follows: when flow occurs around the edges, the main flow is converted into a pair of oppositely directed vortices. The vortex axes lie in the axis of the main flow. The swirl number and the location of the vortex breakdown, provided the latter is intended, are determined by corresponding selection of the setting angle and the arrow angle. The vortex intensity and the swirl number increase as the angles increase, and the location of the swirl breakdown is displaced upstream right into the region of the vortex generator itself. Depending on the use, these cited two angles being predetermined by design conditions and by the process itself. These vortex generators need only be adapted in respect of length and height.

The vortex to be produced along the alveolar structure of the ribs in flow-direction of the cooling medium is ultimately decisive for the selection of the number and the arrangement of the adapted ribs having the form of a vortex generator.

Where the cooling channel is sufficiently narrow, ribs are not required anymore. The higher flow velocity provides enough heat transfer coefficient.

The pins are radially spaced with respect to the flow direction of cooling fluid and extend laterally between the flowed walls. Each of the pins is disposed downstream of a radially aligned with one of the channels of an airfoil. In this way, each of the pins provides an obstruction in the flow exiting each of the sub-channels. Each of the pins is circular in cross section and equal in radial dimension. It should be apparent that a mixture of pins of various shapes and sizes may be used.

Cooling fluid exiting the channels impinges upon one of the pins disposed along the cooled channel. The cooling process results in the one hand in heat being transferred between the pin and the cooling fluid and also results in vortices being generated in the flow flowing past the pins. The vortices generated result in additional heat transfer from the channel surfaces to the cooling fluid. The cooling fluid flowing around the pins then impinges upon the flowed surface of the ribs in the direction of flow. In the other hand, this impingement again results in heat transfer and in the generation of flow vortices with respect to the channel surfaces between the alveolar structures of the ribs.

The spacing between the alveolar structures of the ribs defines an interruption in each of the cooled channels. The interruptions permit cross flow between channels. The cross flow ensures that, in the event that one of the first plurality of cooled channels becomes blocked, cooling fluid will continue to be distributed over the adjacent extent of the channel space. The cross flow through the interruption provides a means to backfill each of the second plurality of sub-channels which is downstream of a blocked first sub-channel of the airfoil. In addition, each of the pins provides an obstruction within the channel which encourages cross flow between channels and facilitates distribution of cooling flow to the whole extension of the channel.

By diffusing the cooling fluid in connection with a channel of a trailing edge, the velocity of the exiting cooling fluid is lowered to reduce the likelihood of separation of the cooling fluid from the trailing edge.

The main advantage of the invention consists in the fact that the cooling structure improved in an essentially measure the heat transfer and reduced consistently cooling air consumption, which leads to a better performance of the engine.

BRIEF DESCRIPTION OF THE DRAWINGS

The invention shall subsequently be explained in more detail based on exemplary embodiments in conjunction with the drawings. In the drawings.

DETAILED DESCRIPTION

In connection with FIG. 1, a cooling channel 100*a* is provided in a rotor blade or guide vane (in the following, for simplicity, is spoken by a rotor blade) of the gas turbine to send a cooling medium 130 therein. The inner wall of the flow cooling path 100 is covered with the heat exchange walls 110*a* and 111*a* in which the pins (see FIG. 2) are provided towards the inner side of the cooling channel 100*a*. The structure of the heat exchange walls 110*a* and 111*a* can be the same as the structure of any other cooling path 101*a*, 102*a*.

When the gas turbine is operated, a high temperature gas 120 is blown towards the rotor blade, and the rotor blade is rotated around a rotation shaft (not shown). The cooling medium 130 is supplied from the base portion of the rotor blade into the cooling channel 100*a*. The cooling medium 130 takes away the heat from the rotor blade and is discharged to a path 131 through which the high temperature gas 120 flows. The heat exchange walls 110*a*, 111*a* are provided on the inner wall of the cooling channel 100*a* to efficiently transfer the heat of the rotor blade to the cooling medium 130.

Since the rotor blade is efficiently cooled by the heat exchange along the channels 100*a*, 101*a*, 102*a*, it is preferably used in the gas turbine in which the higher temperature gas 120 is used. Or, the flow rate of the cooling medium 130 is little as compared with the gas turbine to which the temperature of the combustion gas 120 is equal.

Figure 2:
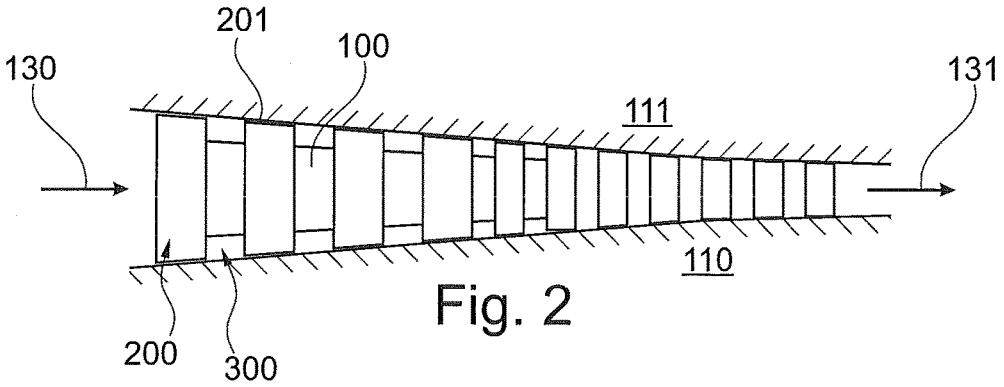
FIG. 2 shows a cross section of the cooling channel comprising pins and ribs.

FIG. 2 shows a cross section of the cooling channel 100 in the region of the trailing edge of the rotor vane or guide vane comprising pins 200 and ribs 300. Rib height h is adapted to pin height, wherein rib height is adapted to certain fraction of pin height. Rib width w at the bottom 201 (see FIG. 4) is adapted to castability requirement, wherein the width should be larger than 60% of the height.

When the height of the rib is low, turbulence generated by the top portion of the rib reaches the base wall 110 and bottom wall 111 plate surfaces to promote heat exchange. The wall 110 and 111 correspond to the pressure side and suction side of the rotor blade or guide vane. This embodiment is effective in case the pin has a low thermal conductivity. The reason of this result is because the base plate of the channel can be cooled more efficiently by cooling the surface of the base plate directly rather than cooling the side face of the pin of the low thermal conductivity. When the diameter of round rib is small, the projection area in the direction of the cooling air flow decreases so that the pressure loss can be suppressed.

The pins 200 are radially or quasi-radially spaced along the channel 100 with respect to the flow direction of cooling medium 130 and extend laterally between the flowed surfaces 110, 111. Each of the pins 200 is transversely disposed to the flow direction of the cooling fluid along the trailing edge of the rotor or guide vane. In this way, each of the pins 200 provides an obstruction in the flow exiting of the flowed channel 100. Each of the pins 200 is circular in cross section and equal in radial dimension. It should be apparent that a mixture of pins of various shapes and sizes may be used.

Figure 1:
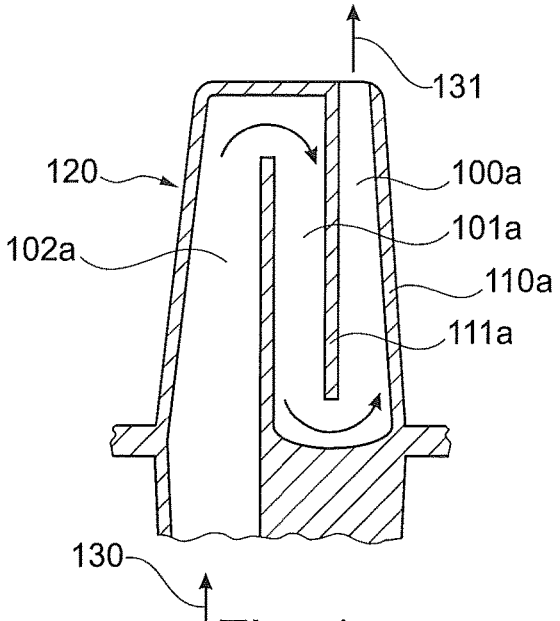
FIG. 1 presents a cross sectional view showing a known to all rotor blade of a gas turbine with a heat exchange wall of the present invention.
Figure 3:
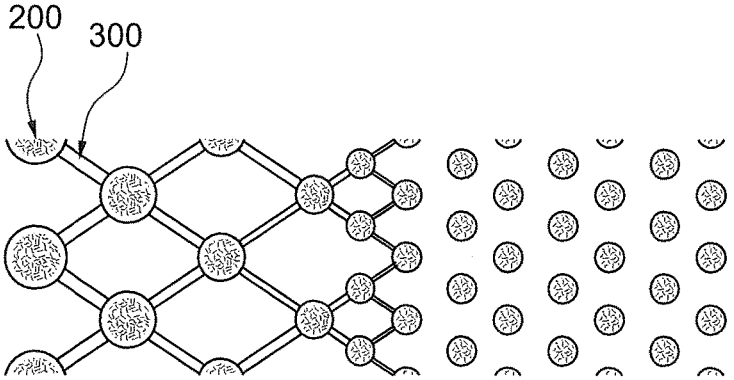
FIG. 3 shows a plan view of the pins and ribs structure along the cooling channel.

FIG. 3 shows a plan view of the pins 200 and ribs 300 structure along the cooling channel 100 resp. 100*a* (see FIG. 1). The rib 300 is disposed along the cooling channel 100 between the pins configuration forming an alveolar or quasi-alveolar structure. This structure of the ribs defines an interruption in each of the cooled channels 100. The interruptions permit cross-flow within cooling channel 100. The cross-flow ensures that, in the event that one of the first portions of cooled channels becomes blocked, cooling fluid will continue to be distributed over the adjacent extent of the channel space. The cross-flow through the interruption provides a means to backfill each of the second plurality of sub-channels (see FIG. 1) which is downstream of a blocked first sub-channel of the airfoil. In addition, each of the pins 200 provides an obstruction within the channel which encourages cross flow between channels and facilitates distribution of cooling flow to the whole extension of the channel. Where the cooling channel 100 is sufficiently narrow, ribs 300 are not required anymore. The higher flow velocity provides enough heat transfer coefficient.

Figure 4:
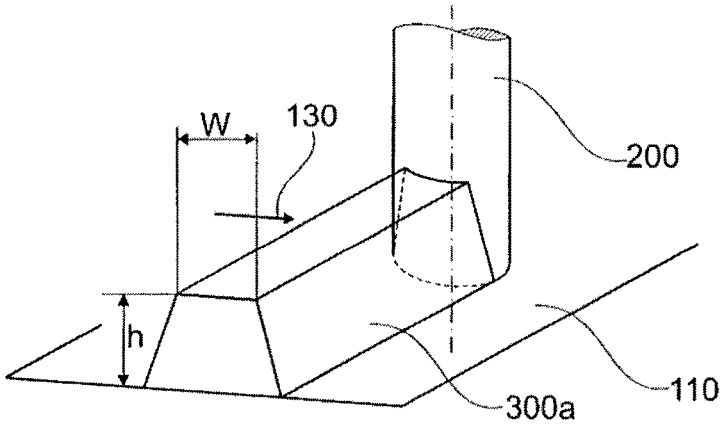
FIG. 4 shows a section of a trapezoidal rib.

FIG. 4 shows a section of a trapezoidal rib 300*a* enclosing the width w and height h configuration.

Figure 5:
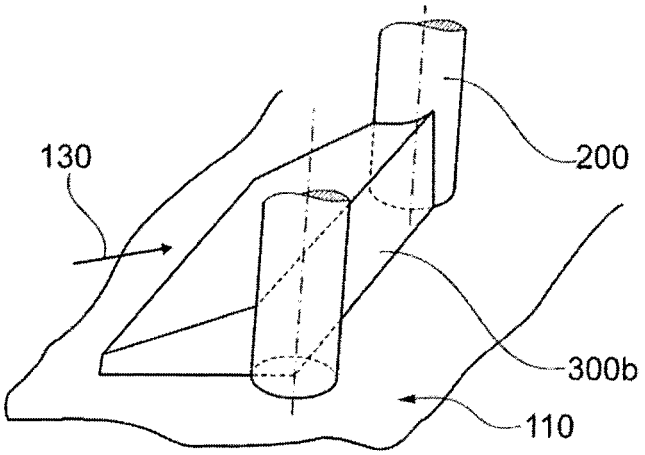
FIG. 5 shows a section of a rib with an inclined surface

FIG. 5 shows a section of a rib between two pins with an inclined surface 300*b*.

Figure 6:
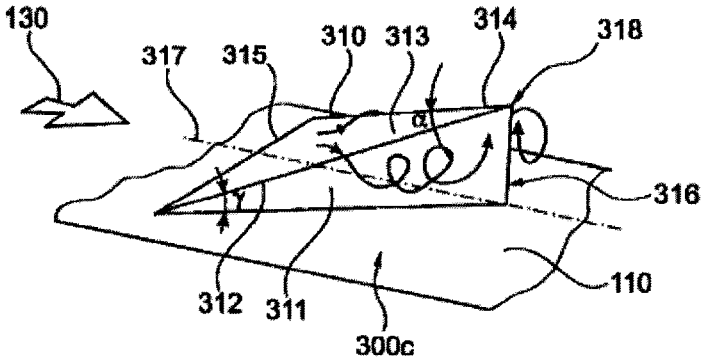
FIG. 6 shows a three-dimensional view of a further rib as vortex generator.

According to FIG. 6, the flow of the cooling medium 130 is shown by an arrow (see FIG. 2), whereby the direction of flow is also predetermined. According to FIG. 6, a vortex generator 300*c* essentially comprises three triangular surfaces around which flow occurs. These are a top surface 310 and two side surfaces 311 and 313. In their longitudinal extent, these surfaces run at certain angles in the direction of flow. The side walls of the vortex generators 300*c*, which preferably consist of right-angled triangles, are fixed, preferably gastight, with their longitudinal sides to the channel or duct wall 110. They are orientated in such a way that they form a face at their narrow sides while enclosing an acute or arrow angle $\alpha$. The face is embodied as a sharp connecting edge 316 and is perpendicular to every duct wall 110 with which the side surfaces are flush. The two side surfaces 311, 313 enclosing the arrow angle $\alpha$are symmetrical in form, size and orientation and they are arranged on both sides of a symmetry axis 317 which is equi-directional to the duct axis.

With a very narrow edge 315 running transversely to the duct through which flow occurs, the top surface 310 bears against the same duct wall 110 as the side surfaces 311, 313. Its longitudinally directed edges 312, 314 are flush with the longitudinally directed edges of the side surfaces 311, 313 projecting into the flow duct. The top surface 310 runs at a setting angle $\gamma$ to the duct wall 110, the longitudinal edges 312, 314 of which form a point 318 together with the connecting edge 316. The vortex generator 300*c* can of course also be provided with a base surface with which it is fastened to the duct wall 110 in a suitable manner. However, such a base surface is in no way connected with the mode of operation of the element.

The mode of operation of the vortex generator 300*c* is as follows: when flow occurs around the edges 312 and 314, the main flow is converted into a pair of oppositely directed vortices, as shown schematically in the figures. The vortex axes lie in the axis of the main flow. The swirl number and the location of the vortex breakdown, provided the latter is intended, are determined by corresponding selection of the setting angle $\gamma$ and the arrow angle $\alpha$. The vortex intensity and the swirl number increase as the angles increase, and the location of the swirl breakdown is displaced upstream right into the region of the vortex generator 300*c* itself. Depending on the operational use, these two angles $\alpha$ and $\gamma$ are predetermined by design conditions and by the process itself. This vortex generator need only be adapted in respect of length, width and height.

In FIG. 6, the connecting edge 316 of the two side surfaces 311, 313 forms the downstream edge of the vortex generator 300*c*. The edge 315 of the top surface 310 running transversely to the duct through which flow occurs is therefore the edge acted upon first by the duct flow.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, preferred or advantageously in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A rotor blade or guide vane airfoil for a gas turbine engine having a longitudinal axis and a source of cooling fluid, the rotor blade or guide vane airfoil comprising:

a pressure wall;

a suction wall;

a leading edge;

a trailing edge;

at least one cooling fluid flow passage in fluid communication with the source of cooling fluid; and means for directing cooling fluid at least to the trailing edge, wherein the at least one cooling fluid flow passage includes:

at least one axially extending wall, each axially extending wall extending laterally between the pressure wall and the suction wall, the at least one axially extending wall, pressure wall and suction wall being spaced within the at least one cooling fluid flow passage such that adjacent walls of the at least one axially extending wall, the pressure wall and the suction wall define a channel between the pressure wall and suction wall, a spacing between the adjacent walls of the at least one axially extending wall, the pressure wall and the suction wall including, in a flow direction of the cooling fluid, pins and ribs, wherein the pins are arranged along a length of the at least one cooling fluid flow passage and extend between the adjacent walls of the at least one axially extending wall, the pressure wall and the suction wall defining the channel, the ribs extend partially between the adjacent walls of the at least one axially extending wall, the pressure wall and the suction wall defining the channel, and the ribs establish a connection between adjacent pins, wherein a pitch of the pins with a larger cross-section in a span-wise direction is equal to or corresponds to a multiple of a pitch of the pins with a smaller cross-section and the pins with smaller cross-section are arranged downstream of the pins with the larger cross-section in the span-wise direction, wherein a dimension of each of the ribs is proportional to a dimension of the pins to which it is connected, a width of the ribs arranged between the pins with the larger cross-section being larger than a width of the ribs arranged between the pins with the smaller cross-section.

2. The rotor blade or guide vane airfoil according to claim 1, wherein the ribs establish a connection between two adjacent pins.

3. The rotor blade or guide vane airfoil according to claim 1, wherein the connection between each adjacent pin extends along at least one portion of a length of the channel in the flow direction of the cooling fluid.

4. The rotor blade or guide vane airfoil according to claim 3, wherein the connection between each adjacent pin extends only along a first portion of length of the channel in the flow direction of the cooling fluid.

5. The rotor blade or guide vane airfoil according to claim 1, wherein the ribs having a square or rectangular or trapezoidal cross-section.

6. The rotor blade or guide vane airfoil according to claim 5, wherein a leading face of each rib with respect to the flow direction of the cooling fluid comprises an inclined or tapered surface.

7. The rotor blade or guide vane airfoil according to claim 5, wherein the trapezoidal cross-section has a top width that is larger than 60% of a height of the ribs.

8. The rotor blade or guide vane airfoil according to claim 1, wherein the ribs between two adjacent pins consists of at least one vortex generator having three triangular surfaces.

9. The rotor blade or guide vane airfoil according to claim 1, wherein a pitch of the pins in a span-wise direction is decreased as a channel height and a pin cross section gets smaller.

* * * * *